US010910725B2

(12) United States Patent
Goh et al.

(10) Patent No.: US 10,910,725 B2
(45) Date of Patent: Feb. 2, 2021

(54) DUAL CONTRA-WOUND HELICAL ANTENNA FOR A COMMUNICATION DEVICE

(71) Applicant: MOTOROLA SOLUTIONS, INC, Chicago, IL (US)

(72) Inventors: Poh Imm Goh, Pulau Pinang (MY); Teik Yang Goh, Bayan Lepas (MY); Alexander Oon, Bayan Lepas (MY); Seow Teng Wong, Georgetown (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 44 days.

(21) Appl. No.: 16/079,117

(22) PCT Filed: May 16, 2016

(86) PCT No.: PCT/MY2016/000027
§ 371 (c)(1),
(2) Date: Aug. 23, 2018

(87) PCT Pub. No.: WO2017/200371
PCT Pub. Date: Nov. 23, 2017

(65) Prior Publication Data

US 2019/0074594 A1 Mar. 7, 2019

(51) Int. Cl.
*H01Q 11/08* (2006.01)
*H01Q 1/24* (2006.01)
*H01Q 5/307* (2015.01)

(52) U.S. Cl.
CPC ..... *H01Q 11/08* (2013.01); *H01Q 1/242* (2013.01); *H01Q 5/307* (2015.01)

(58) Field of Classification Search
CPC ..... H01Q 1/36; H01Q 1/243; H01Q 1/52; H01Q 11/08; H01Q 5/30
See application file for complete search history.

(56) References Cited

U.S. PATENT DOCUMENTS 4,725,845 A * 2/1988 Phillips ..... H01Q 1/27 343/702
5,274,388 A * 12/1993 Ishizaki ..... H01Q 21/29 343/725

(Continued)

FOREIGN PATENT DOCUMENTS

GB 2380323 A1 4/2003
GB 2418781 A 4/2006

(Continued)

OTHER PUBLICATIONS

The International Search Report and the Written Opinion, corresponding patent application No. PCT/MY2016/000027, filed May 16, 2016, dated Jan. 24, 2017, all pages.

(Continued)

*Primary Examiner* — Hasan Z Islam
(74) *Attorney, Agent, or Firm* — Barbara R. Doutre

(57) ABSTRACT

An antenna is provided having a primary helical coil (102) and a secondary helical coil (104) contra-wound relative to the primary helical coil. Switchable coupling between the coils allows the antenna response to switch from lower to higher frequency responses within the same Ultra High Frequency (UHF) band. A bandwidth of the same physical length antenna can be increased up to twice the bandwidth or for a fixed bandwidth, the antenna length can be shortened. For the high frequency band, when the secondary helix is disconnected from the primary helix, the primary coil operates as a interferer notch out to improve interference rejection, to reject unwanted signals from nearby radios transmitting in frequencies separated by duplex spacing, such as Terrestrial Trunked Radio (TETRA) and cellular Global System for Mobile (GSM) communication bands.

11 Claims, 8 Drawing Sheets

(56) References Cited

U.S. PATENT DOCUMENTS

| | | | | |
|---|---|---|---|---|
| 5,469,177 | A * | 11/1995 | Rush | H01Q 1/244 343/702 |
| 5,808,586 | A * | 9/1998 | Phillips | H01Q 1/242 343/895 |
| 5,990,848 | A | 11/1999 | Annamaa et al. | |
| 6,249,262 | B1 | 6/2001 | Lin et al. | |
| 6,437,751 | B1 | 8/2002 | Craven et al. | |
| 6,452,569 | B1 | 9/2002 | Park et al. | |
| 6,459,412 | B1 * | 10/2002 | Koyanagi | H01Q 1/243 343/702 |
| 6,765,536 | B2 | 7/2004 | Phillips et al. | |
| 6,768,464 | B1 * | 7/2004 | Shoji | H01Q 1/243 343/700 MS |
| 6,876,337 | B2 | 4/2005 | Larry | |
| 7,079,079 | B2 * | 7/2006 | Jo | H01Q 1/243 343/700 MS |
| 7,495,619 | B2 | 2/2009 | Fossett | |
| 8,378,920 | B2 * | 2/2013 | Shlager | H01Q 1/362 343/876 |
| 8,988,293 | B2 | 3/2015 | Lim | |
| 2011/0037679 | A1 | 2/2011 | Shlager et al. | |
| 2013/0328743 | A1 | 12/2013 | Coburn et al. | |
| 2014/0232611 | A1 * | 8/2014 | Ochoa | H01Q 1/288 343/881 |
| 2015/0071648 | A1 * | 3/2015 | Hong | G06F 3/0416 398/131 |

FOREIGN PATENT DOCUMENTS

| | | | |
|---|---|---|---|
| JP | 08298410 | A | 11/1996 |
| WO | 2005078862 | A1 | 8/2005 |

OTHER PUBLICATIONS

Notification of Reasons for Rejection, corresponding JP patent application No. 2018-560201 dated Oct. 1, 2019, all pages.

* cited by examiner

AVERAGE AZIMUTH GAIN,dB

900

1ST BAND:72MHz
2ND BAND:20MHz
USABLE BANDWITH:92MHz

DUAL CONTRA-WOUND HELICAL ANTENNA FOR A COMMUNICATION DEVICE

FIELD OF THE INVENTION

The present invention relates generally to antennas and more particularly to helical coil antennas used for a communication device.

BACKGROUND

Portable battery-powered communication devices, such as portable two-way radios, often operate utilizing an external antenna. Size constraints and efficiency of operation are major concerns in the antenna design incorporated into such devices. Prohibitively large structures can cause the antenna to be very stiff, susceptible to breakage as well as being visibly obtrusive in certain work environments, such as security at airports, train stations, bus terminals and shipping ports. Hence, any new antenna structure should minimize size and impact on the physical user interface of the radio device. Overall complexity, likewise impacts cost and ease of manufacturability and thus should also be considered when developing a new antenna structure.

A challenge with radio antenna design can occur in environments where external radiated transmit interferers are likely to occur and potentially desensitize the radio receiver. Likewise radiated wideband emissions generated from the antenna should be minimized so as not to interfere with other radios within the area. An area of design challenge interest pertains to those systems operating in closely spaced transmit and receive frequency bands, where those frequency bands are associated with duplex and/or split frequency) operation. For example, while full duplex radio operation may be obtainable for a Trans-European Trunked Radio (TETRA) in which the transmit frequency and the receive frequency are different and separated by "duplex-spaced" frequency spacing using Time Division Multiple Access (TDMA) at a different slot, the potential for interferes remains significant. Operation of such devices in fringe coverage areas of busy radio environments can cause susceptibility to interferers in receive mode, particularly to systems having duplex spacing. If a transmitting radio in one conversation of the fringe coverage area transmits to the base station, while a nearby receiving radio is in another conversation, or even just in standby mode, in the fringe coverage area, the trunked mode radio transmit interferer from the nearby transmit radio may transmit with sufficient power to cause the receiving radio to drop a call, or prevent (jam) the standby radio from receiving an incoming call. Therefore, the ability to improve antenna performance by rejecting interferers is highly desirable. Additionally, for transmit mode, radiated wideband emissions generated from the antenna should be minimized so as not to interfere with other radios within the area. Radio parameters, for example, bandwidth, efficiency, size, and ease of manufacturability are all factors to be considered during the design of an antenna.

Accordingly, it would be beneficial to have a new antenna particularly for portable communication devices, such as portable radios, operating in environments susceptible to interferers.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
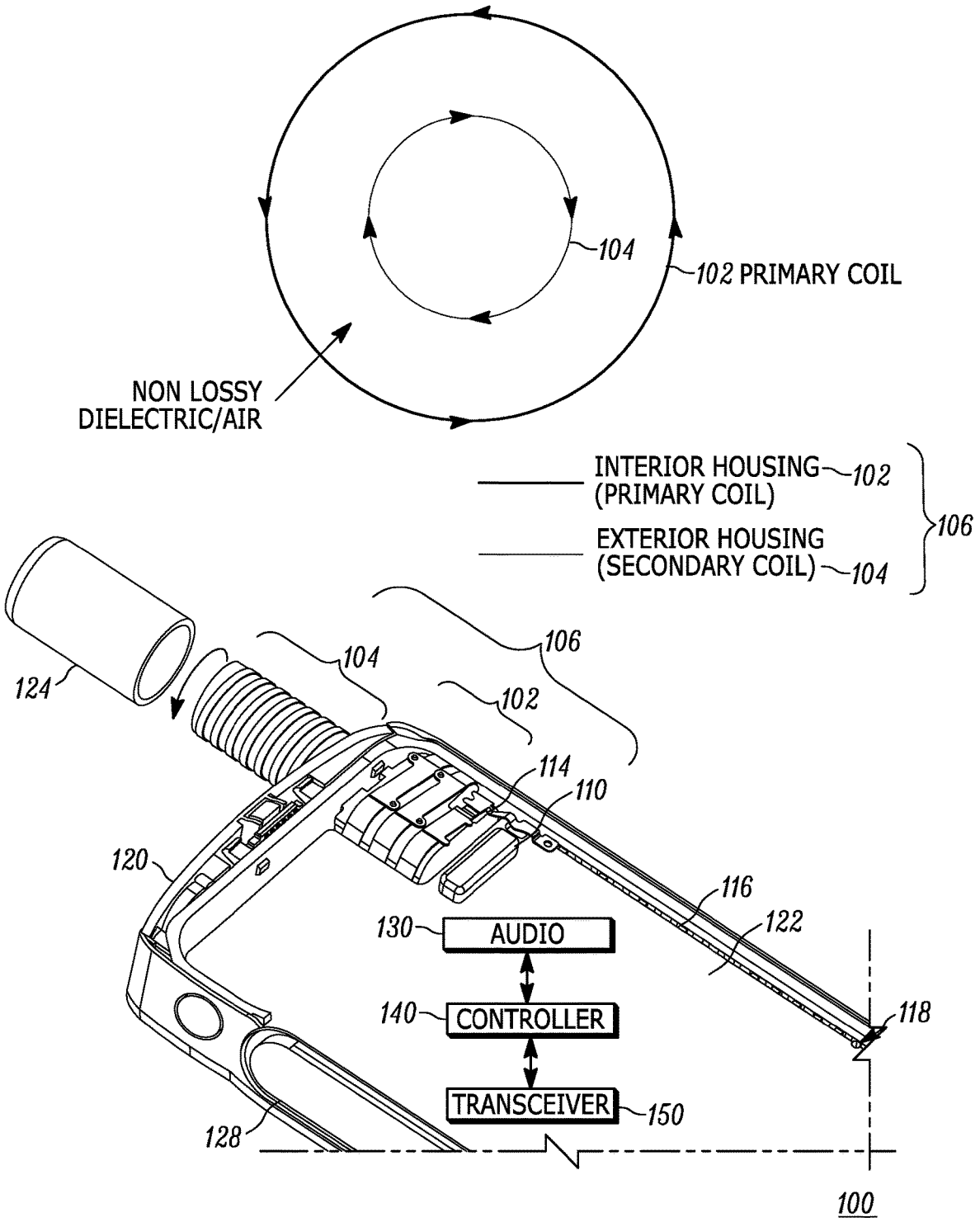
FIG. 1 is a cutaway view of a portable communication device incorporating a switchably coupled dual contra-wound antenna formed and operating in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Before describing in detail embodiments that are in accordance with the present invention, it should be observed that the embodiments reside primarily in an antenna for a portable communication device, such as a portable two-way radio, in accordance with various embodiments. Portable radios such as those with tight transmit, receive frequency spacing requirements operable in full-duplex using TETRA, TDMA, and/or further providing half-duplex operation with same or similar spacing requirements can all benefit from the antennas provided herein. The antennas provided by the various embodiments are suitable for other applications in portable communication devices where shorter, smaller antenna are desired with the ability to selectively provide for passband selectivity and adjustment of interference rejection. In some embodiments, to be described herein, a switchably coupled dual contra-wound antenna switches between a first lower response operating mode and a second higher response operating mode within the same frequency band. The switchably coupled dual contra-wound antenna allows the portable radio to be less susceptible to interference usage in busy radio traffic environments, such as transportation stations, for example airports, train stations, and the like. In a transmit mode of operation, first and second non-overlapping helical coils are connected together via a switch to form a radiating antenna element allowing for low wideband noise radiated emissions. In a receive (RX) mode of operation, the antenna coils are disconnected, such that one helical coil operates as the primary radiating element and the other secondary helical coil operates as a parasitic element to notch out interference at known interferer frequencies that could be generated by nearby radios. The switchably coupled dual contra-wound antenna is thus well suited for busy radio traffic environments.

In some other embodiments, there is provided a switchably coupled dual contra-wound antenna formed of non-overlapping helical coils for a wideband application that can be used to reduce antenna length while achieving out of band interferer rejection performance.

FIG. 1 is a partial cutaway view of a portable communication device incorporating an antenna formed in accordance with some embodiments. Portable communication device 100 may be a battery operated, portable radio, such as a handheld, two-way radio, or other portable electronic device comprising a housing 120 within which is mounted one or more printed circuit boards (pcb) 122. Upon the pcb 122 are mounted radio circuits and hardware, including but not limited to, audio circuitry 130, controller 140, and transceiver 150 which are inter-operatively coupled for radio communications. A push-to-talk (PTT) button 128 is located on a side surface of housing 120 and is inter-operatively coupled via the controller 140 to enable radio transmit functions. For the purposes of this application, the portable communication device 100 will at times be referred to simply as a radio.

Operation of the radio circuitry provides for two-way radio communication, under control of the PTT button 128 for transmit, where the user presses the PTT button to transmit and releases the button to stop transmitting, leaving the radio in a standby mode in which the radio can receive. In accordance with some embodiments, radio 100 operates for example in a TETRA System in which the transmit frequency and the receive frequency are separated by narrowly spaced frequency bands associated with duplex channel spacing and the problems associated therewith. Transmit mode is enabled using the push-to-talk (PTT) button 128 to transmit to a base station, and disabled by releasing the PTT button, thereby operating in a half-duplex operational mode of communication from a user point of view, but using the narrow channel spacing associated with full duplex. However, operation of radio 100 is advantageously able to avoid predetermined interferers in receive mode (as well being able to advantageously minimize emissions in transmit mode), even when radio 100 is operating in fringe coverage areas of busy environments through the use of antenna 106 formed and operating in accordance with some embodiments.

In accordance with some embodiments, antenna 106 comprises a primary helical coil 102 and a secondary helical coil 104, the secondary helical coil 104 being contra-wound relative to the primary helical coil 102. In accordance with this embodiment, the primary helical coil 102 and secondary helical coil 104 are non-overlapping. In this embodiment, the secondary helical coil 104 is located on the exterior of radio housing 120 and covered by a cap or cover 124, while the primary helical coil is located within the interior of the radio housing, thereby minimizing overall physical length of the radio. A cross sectional view has been provided to emphasize the contra-winding, the cross sectional view shows non lossy dielectric/air between the primary helical coil 102 and the secondary helical coil 104 as the coils are completely separated, non-overlapping.

The antenna arrangement is controlled via a switch 110 for switchably coupling the secondary helical coil 104 to and from the primary helical coil 102. The primary helical coil 102 remains operating as the main RF antenna at all times, while the secondary helical coil 104 provides improved interference rejection as a parasitic element to notch out or block the interferer, also known as a suckout trap, in a high frequency narrowband mode of operation during receive or standby while awaiting an incoming call. The antenna 106 provides improved radiated emissions during transmit mode in a low frequency narrowband mode of operation.

While the narrow frequency bandwidths are controlled by the first and second helical coils 102, 104 of antenna 106, an interconnect spring 114 couples the primary helical coil 102 to an RF radiator strip 116 for additional tunability. The RF radiator trace 116 is etched into the pcb 122, through appropriate layers and connected to the transceiver 150. The electrical length of the RF radiator trace 116 along with matching components (not shown) near transceiver 150, the type of switch 110, the length of the non-overlapping, contra-wound helical coils 102, 104 can be adjusted to suit particular frequency applications for predetermined spacing requirements.

By incorporating the dual contra-wound antenna 106, the radio 100 is able to operate at a predetermined frequency band of interest selected for operation with antenna performance optimized at within a desired frequency band of interest. For example, may be designed to operate at a TETRA Uplink band of 415.5-420 MHz and a Downlink band of 460-464.5 MHz having duplex spacing of 44.5 MHz. Adjustment to the coil materials, tuning components can be made for other frequency bands of interest and channel spacing.

Figure 2:
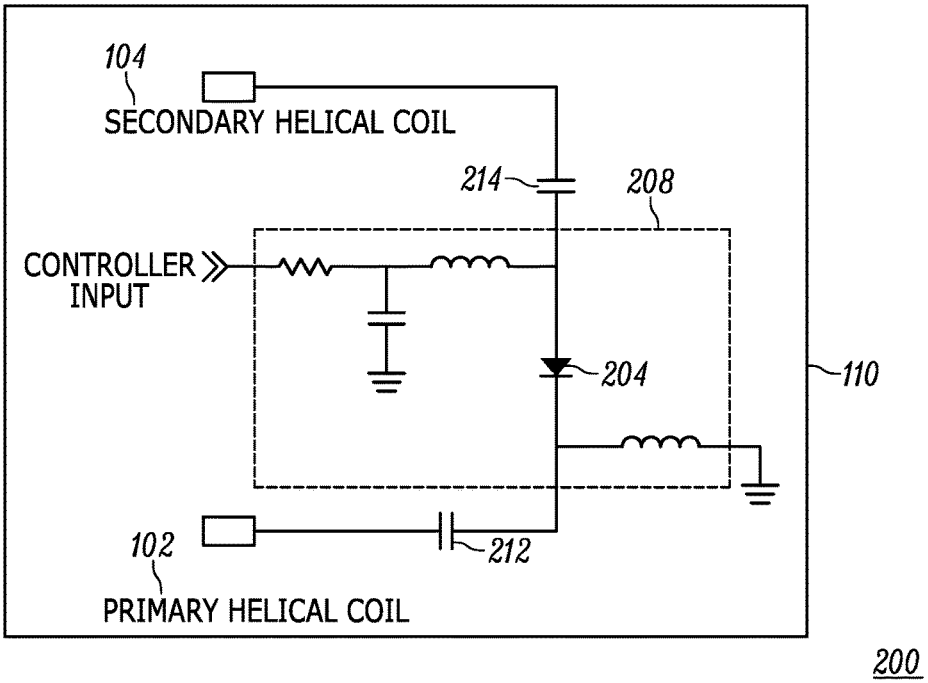
FIG. 2 is an example of a switch for controlling the dual contra-wound antenna in accordance with some embodiments.

FIG. 2 is an example of a switch 200 for controlling the dual contra-wound antenna 106, formed of primary helical coil 102 and secondary helical coil 104 in accordance with some embodiments. Switching between the coils is provided via a PIN diode 204 which is biased using resistive, capacitive, and inductive components 208 in a manner known in the art. Capacitors 212, 214 provide DC blocking to the coils. The pin diode 204 operates as the RF switch connecting the primary helical coil 102 to the secondary helical coil 104, upon activation of the PTT (controller trigger). The pin diode 204 disconnects the primary helical coil 102 from the secondary helical coil 104 in response to input received from controller 140 based on a switch control algorithm of controller 140 of FIG. 1.

While the switch 200 is shown and described as a radio frequency (RF) switch other configurations, circuits, and even other switches, known or yet to be developed, may also be envisioned. Operationally switch 200 provides single pole single throw operation. For example, switches formed using MEMs technology or other switch technology suitable for conducting RF frequencies through helical coils in such a manner that ensures that two helical coils can connected, mutually coupled, conduct and can be disconnected/reconnected can be envisioned.

Figure 3:
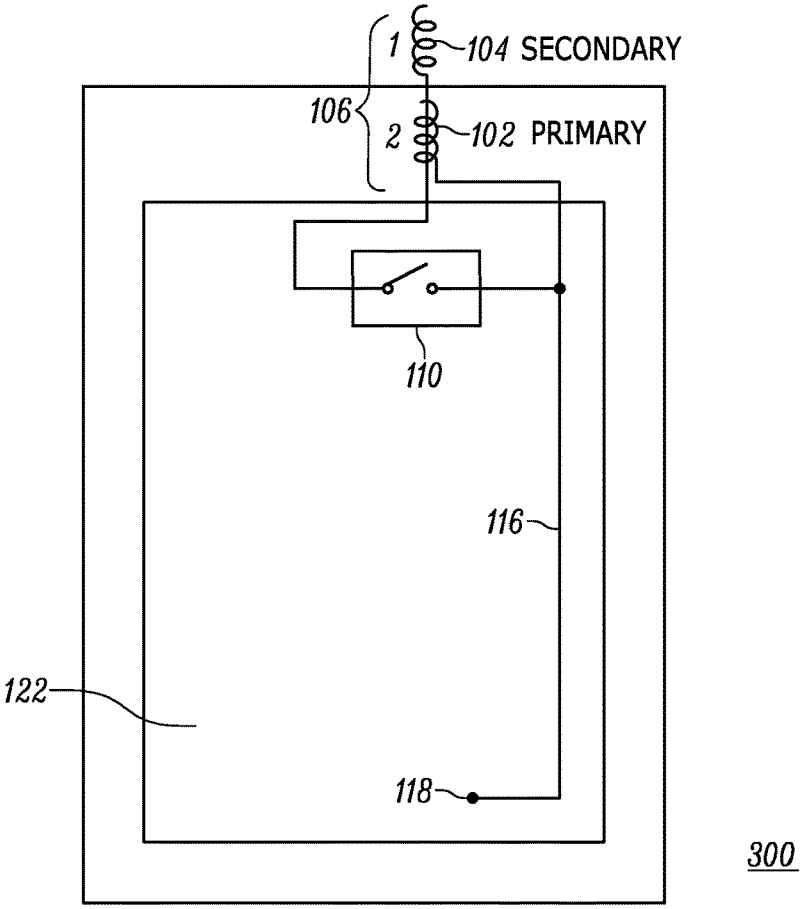
FIG. 3 is a block diagram of the portable communication device incorporating the switchably coupled dual contra-wound antenna formed and operating in accordance with some embodiments.

FIG. 3 is a block diagram of the portable communication device 100 incorporating the switchably coupled dual contra-wound antenna 106 formed and operating in accordance with some embodiments. Antenna 106 is a non-overlapping, dual contra-wound antenna 106 formed of primary helical coil 102 and secondary helical coil 104. The switch 110 is shown in its operational form as a single pole single throw switch which switchably couples (connects/disconnects) the center loaded secondary helical coil 104, basically coupling the first and second coils in parallel.

Table 1 shows operational characteristics for radio 100 with switch 110 ON and switch 110 OFF. The switch 110 at the center loaded, secondary helical coil 104 allows the antenna response to be switched from lower frequency (switch 110 ON) to higher frequency (switch 110 OFF) within the same ultra high frequency (UHF) band. A bandwidth of the same physical length antenna can be increased up to twice the bandwidth, or for a fixed bandwidth, the antenna length can be shortened. For the high frequency band, when the secondary helical coil 104 is disconnected from the primary helical coil 102, the primary coil operates as an interferer notch element, the 'suckout trap' previously mentioned to improve interference rejection of unwanted signals from nearby radios. For example, nearby radios transmitting in frequencies separated by known duplex frequency spacing, such as cellular Global System for Mobile (GSM) communication bands can now be blocked.

Table 2 shows a summary of the operation for antenna 106:

| | Type of windings | Switch On | Switch Off | Remarks |
|---|---|---|---|---|
| Radio 100 | Non-overlap | Narrowband-Passband at F1, rejection at F2 | Narrowband - Passband at F2, rejection at F1. | Two independent resonant frequencies |

Accordingly, antenna 106 formed in accordance with some of embodiments is operable over a passband comprising: a narrowband uplink passband with a center frequency at F1 and rejection at F2 when the switch is on; and a narrowband downlink passband at with a center frequency at F2 and rejection at F1 when the switch is off. Tunability advantages obtained from the antenna 106 have been able to achieve improved interference rejection with the switch off than with switch on. Although this interference rejection will vary based on design parameters the tunability and ability to tweak the two, non-overlapping helical coils 102, 104, and particularly secondary helical coil 104 as the parasitic element, during the antenna design, makes antenna 106 highly desirable for portable radio RF applications.

To be more precise when the switch turns ON, the primary helical coil couples to the secondary helical coil provides an antenna operable over a first predetermined frequency passband having a first center frequency F1, with rejection at F2. When the switch turns OFF, the primary helical coil disconnects from the secondary helical coil, providing an antenna operable over a second predetermined frequency passband having a second center frequency F2, with rejection at F1. The first predetermined frequency passband and the second predetermined frequency passband are within the same duplex channel spacing of each other.

Figure 4:
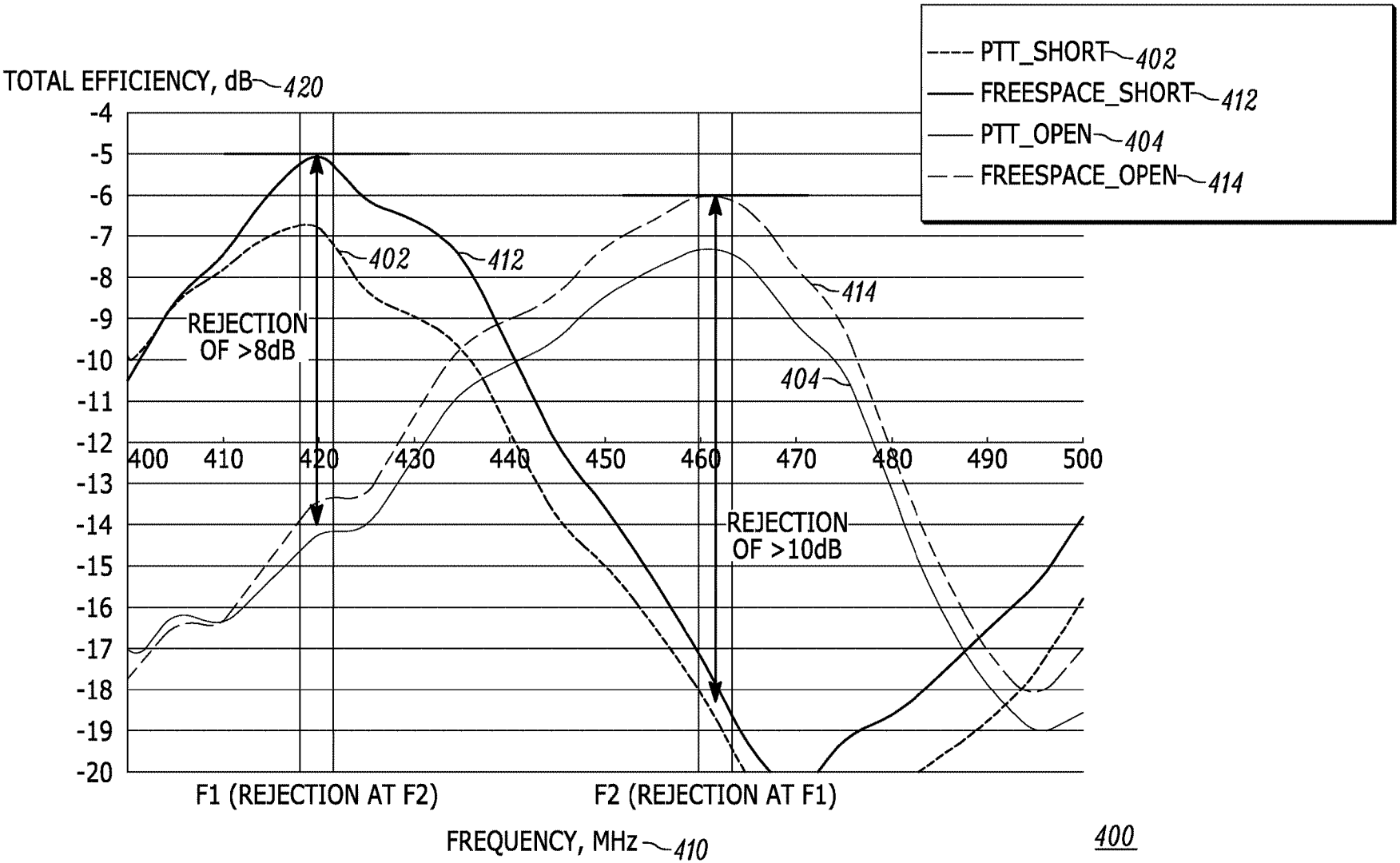
FIG. 4 is a graph of an example for operation of a portable communication device incorporating a switchably coupled dual contra-wound antenna formed and operating in accordance with some embodiments.

FIG. 4 shows a graph 400 providing an example of a radio 100 assigned to operate at a TETRA Uplink band of 415.5-420 MHz and a Downlink band of 460-464.5 MHz having Duplex Spacing of 44.5 MHz incorporating the dual contra-wound antenna 106 formed in accordance with some of the embodiments. Graph 400 shows total efficiency on the vertical axis in (dB) and frequency in (MHz) along the horizontal axis 410. Two sets of narrowband passband samples are shown. With the RF switch 110 turned ON, the passband 402 and 412 are shown at lower passband F1 with rejection at F2. With the RF switch 110 turned OFF, the passband 404 and 414 move up to higher passband F2 with rejection at F1.

Accordingly, Graph 400 shows that when the radio 100 would be operating in a RX mode (switch 110 OFF) moving down to the lower narrow passband, antenna 106 is able to "suckout" an externally transmitted interferer with greater than 8 dB of rejection. Graph 400 further shows that where the radio would be in TX mode (switch ON) moving up to higher narrow passband, antenna 106 is able to "minimize transmitted emissions.

Accordingly, using dual contra-wound antenna 106, the system performance achieved improved interference rejection and improved minimized transmission emissions. Thus, the dual contra-wound antenna can be operated beneficially in the second operating mode, wherein the switch is open and the secondary helical coil 104 operates as a parasitic element to provide a "suckout trap" for an interferer.

By using the contra-wound antenna, an additional (>8 dB) rejection at the RX band can be achieved in the use case as shown in Table 2 and Graph 400. Table 2 provides a summary of how the antenna 106 performed in terms of an interferer being able to move closer to antenna 106 and reducing the impact of antenna 106 to surrounding radios. Continuing to refer to Graph 400, an example of a use case is outlined below for operation switching from the switch ON mode to the switch OFF mode for the contra-wound antenna:

TABLE 2

TABLE 2 USE CASE EXAMPLE FOR SUCKOUT TRAP

| Parameter | RX MODE ANTENNA SW OPEN/DISCONNECTED | TX MODE ANTENNA SW CLOSED/CONNECTED |
|---|---|---|
| Frequency | 460 MHz | 415 MHz |
| power of radio | 32.5 dBm | 32.5 dBm |
| Receiver Desensitization | 88 dB | |
| rejection of Radio (freespace) | | |
| TX Wideband noise from the radio | | 32.5 − 100 = −67.5 dBm |

TABLE 2-continued

TABLE 2 USE CASE EXAMPLE FOR SUCKOUT TRAP

| Parameter | RX MODE ANTENNA SW OPEN/DISCONNECTED | TX MODE ANTENNA SW CLOSED/CONNECTED |
|---|---|---|
| RX Desensitization rejection of Radio with Dual-Contra-Wound Antenna (Switch closed) | 88 + 8 = 96 dB | |
| RX radio sensitivity | −116 dBm | −116 dBm |
| RX noise floor | −116 − 8.25 = −124.25 dBm | −124.25 dBm |
| Antenna Gain | −5 dB | −5 dB |
| Required path loss without Dual Contra-Wound Antenna | 2.5 − 88 − (−124.25) = 68.75 dB | −67.5 − (−124.25) = 56.75 dB |
| Required distance not affecting radio based on Free space path loss (FSPL) formula | 45 m | 13 m |
| With Dual Contra-Wound Antenna, required free space path loss (FSPL) can be reduced by additional rejection due to the antenna suckout trap. (this example shows 8 dB and 10 dB) | 68.75 − 8 = 60.75 dB | 56.75 − 10 = 46.75 dB |
| Required distance not affecting the radio based on Free space path loss (FSPL) formula | 18 m (from 45 m) | 4 meter (from 13 m) |

Table 2 and Graph 400 show that by using the contra-wound antenna 106, an additional (>8 dB) rejection at the RX band can be achieved and further show Transmit Wide-band noise can be reduced by >10 dB during transmit from antenna 106. This is especially useful for crowded places with many radio users such as in the airport or other transport environments. The ETSI requirement EN300-394-1 for the Transmit Wideband Noise at >10 MHz away is required to be less than −100 dBc. By using the contra-wound antenna 106, an additional (>8 dB) rejection at the RX band can be achieved.

For TX wideband noise, it is radio 100 is looked at as potentially impacting a nearby radio. If radio 100 were to have a standard normal antenna, it would cause interference from its noise floor with another similar radio at 13 meters away, but with radio 100 incorporating the antenna 106, the wideband noise gets sucked out allowing the radio 100 to be closer to other radios by around 4 meters without causing interference.

For RX Desensitization rejection, a radio 100 having a normal antenna operating in RX radio would have to be located at least 45 meters away from a nearby full power transmit radio causing an incoming interferer without affecting its range based on the freespace path loss calculation. However by incorporating the antenna 106 into radio 100, the RX radio can be closer to the interferers by 18 meters.

When viewed in terms range area, the range is calculated based on the area that can be cover from the radius A=PI RA^2. In this case, the range can be reduced from 530.93 sq meters to 50.27 sq meters, meaning the noise from the noise floor of antenna 106 will not have a significant impact on another radio.

In accordance with some embodiments, the antenna 106 can be adjusted via the helical windings, conductive trace 116 to operate over other predetermined narrowband pass-bands having predetermined frequency spacing based on system requirements. For example, the antenna 106 can be adjusted via the helical windings, conductive trace 116 to operate over other predetermined narrowband passband Uplink bands and predetermined Downlink bands having predetermined duplex spacing based on system requirements. For example, radios operating in Terrestrial Trunked Radio (TETRA) systems and cellular Global System for Mobile (GSM) communication bands can take advantage of the antennas described by the various embodiments.

Figure 5:
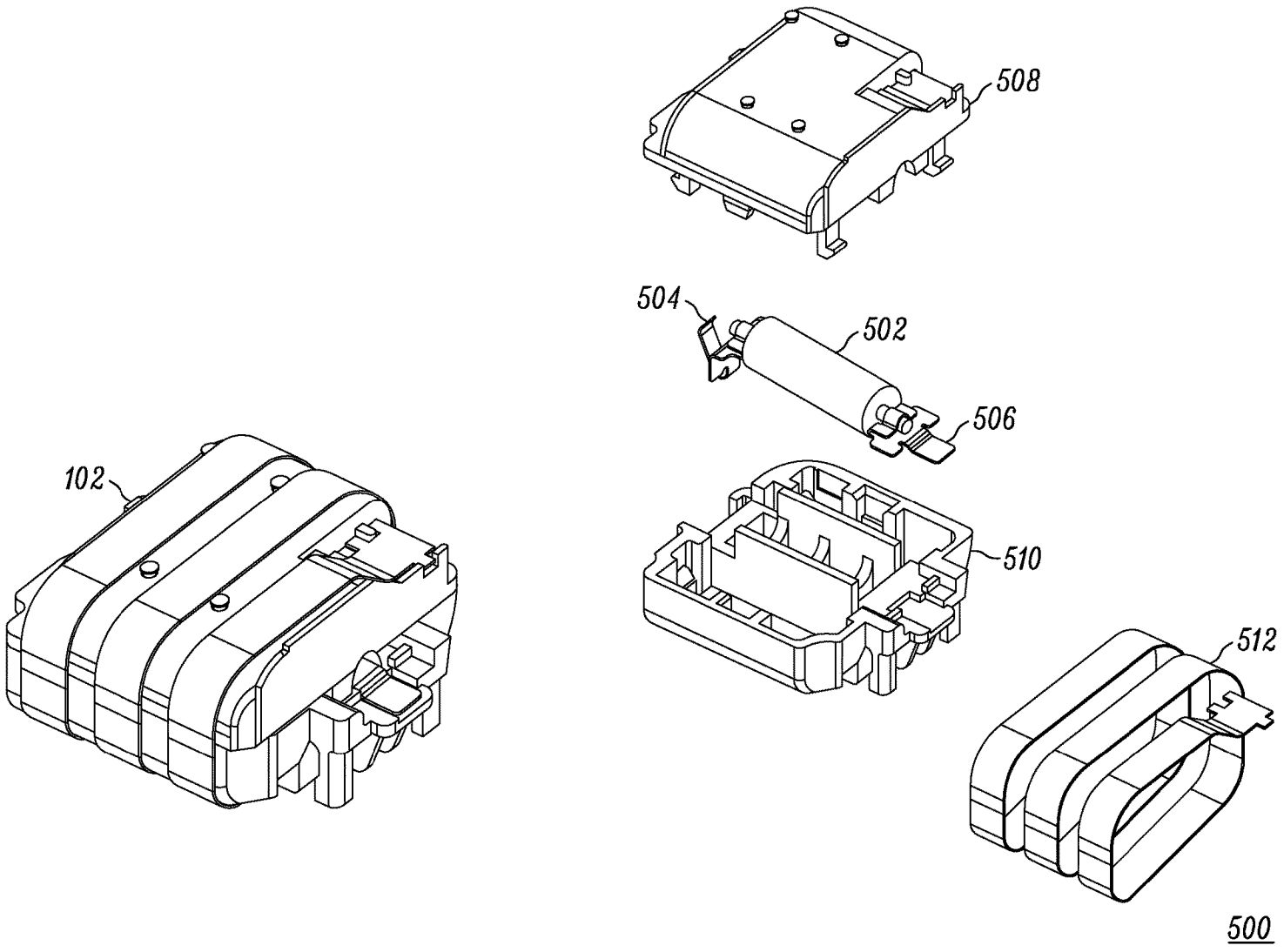
FIG. 5 is an exploded view for an interior helical assembly portion of a primary helical coil of the dual contra-wound antenna in accordance with some of the embodiments.

FIG. 5 is an exploded view for an interior helical assembly portion 500 of the primary helical coil 102 of the dual contra-wound antenna 106 formed in accordance with some embodiments. An inner coax cable 502 providing an inner conductor and dielectric with outer shield removed is coupled between two internal contact plates 504, 506 and housed within housing, preferably formed of first and second plastic piece parts 508, 510. The spring contact 504 and plate contact 506 are accessible externally of the housing. An electrical flex 512, suitable wire, or other suitable conductor suitable to helical coil formation is coupled to spring contact 504 and wrapped around the housing in a helical coil fashion. The housing may have pre-positioned alignment tabs or other alignment means to facilitate with the wrapping of the flex. Contact plate 506 extends externally to the housing thereby providing interconnect spring 114 from FIG. 1 for interconnection to a circuit board. The completed assembly is shown as helical coil 102 from FIG. 1. Other assembly approaches are also possible, however assembly approach 500 facilitates the primary helical coil being fitted within a portable radio well suited to business two-way radio markets where a small inconspicuous antenna with good performance is highly desirable.

Figure 6:
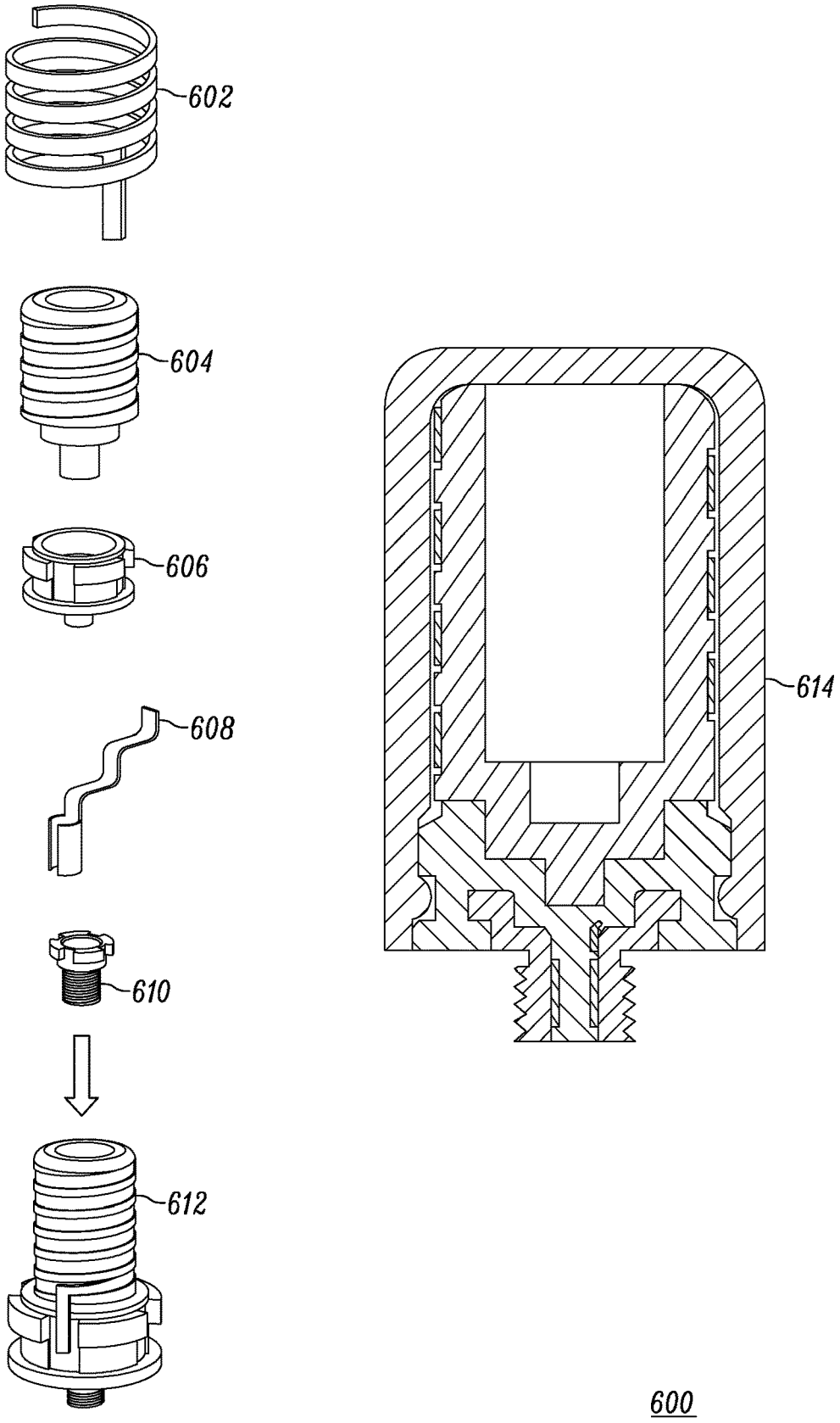
FIG. 6 is an exploded view of an exterior helical assembly portion for a secondary helical coil of the dual contra-wound antenna in accordance with some embodiments.

FIG. 6 is an exploded view of an exterior helical assembly portion 600 for the secondary helical coil 104 of the dual contra-wound antenna 106 in accordance with some of the embodiments. A radiating element 602 can be formed of a flex, a wire, or other suitable radiating conductor that can be formed into a helical coil. In accordance with the embodiments, the direction of rotation needs to be contra-wound relative to the primary coil 512. The flex 612 may be wrapped upon a tube, such as a flex dressing tube, for example formed of non-conductive, non-lossy dielectric material suitable for supporting a helical coil antenna. An overmold 606 provides additional support and rigidity to permit a metal contact 608 and metal stud connector 610 to be mounted thereto. The assembly is then capped or over-molded with a cover 614 (cover 124 of FIG. 1) leaving the stud connector exposed for mounting to the radio housing 120 of radio 100. While other configurations may also be used, an overall length of approximately 20 mm for a radio of 107 mm length has shown to be suitable. Here again, the overall goal of the assembly approach is directed to facilitating a secondary helical coil that, since it is exterior to the portable radio, is small inconspicuous to the user while good performance when operating in conjunction with the primary helical coil.

Figure 7:
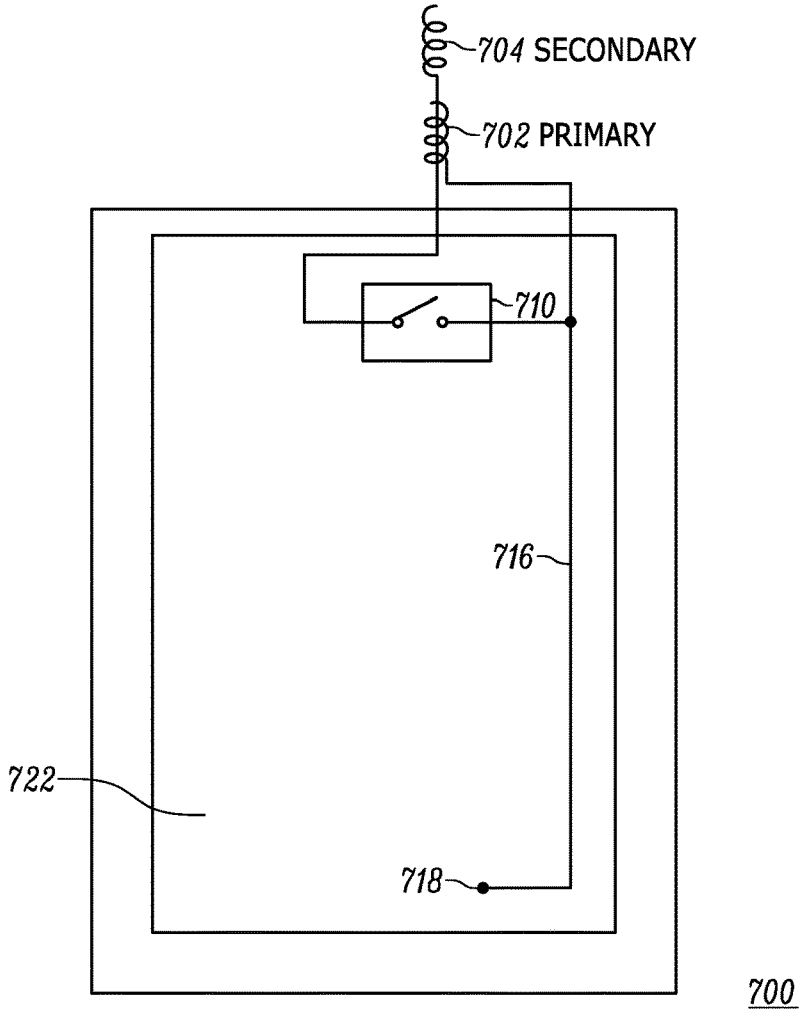
FIG. 7 is an alternative embodiment for a switchably coupled dual contra-wound antenna incorporated into a portable communication device in accordance with some embodiments.

FIG. 7 is a block diagram of a portable communication device 700 incorporating an antenna 706 formed and operating in accordance with some alternative embodiments. Portable communication device 700 is similar to those previously described in terms of being a portable, PTT, two-way radio-type device having controller, audio, and transceiver, and appropriate supporting circuitry operating in narrowband frequencies with narrow passband operating frequencies-however the size of the radio in this embodiment is not so constrained. Performance is similar to that described in the previous embodiments but without the size constraints.

Similar to the previously described embodiments, portable communication device 700 operates the antenna 706 comprises a primary helical coil 702 and a secondary coil 704, the secondary helical coil being contra-wound relative to the primary helical coil. However, in this embodiment, both coils are located exterior to the portable communication device 700. A switch 710, such as an RF switch, MEMs switch or other suitable switch for conducting RF frequencies, is located interior to the portable communication device 700 and is switchably loaded between the two helical coils. Switch 710 is open for receive/standby mode, allowing only for electromagnetic coupling between the coils, and switch 710 is closed for transmit mode, shorting the two coils together. Pressing of PTT 728 controls closing the switch 710, while releasing PTT 728 opens the switch, the switch remains open during standby and receive.

In this embodiment, the portable communication 700 is not faced with the same size constraints as the radio 100 of FIG. 1-3, thereby permitting the antenna 706, to be located exterior to the device. With fewer limitations on the size constraints both the primary and secondary helical coils 702, 704 have been located outside of the radio housing, appropriately mounted and sleeved in accordance with the space permitted by the radio's control top. Appropriate frequency bands can designed and tuned via the radiator strip 716 etched into pcb 722 or other matching components not shown on pcb 722 associated with feed point 718 and transceiver.

Figure 8:
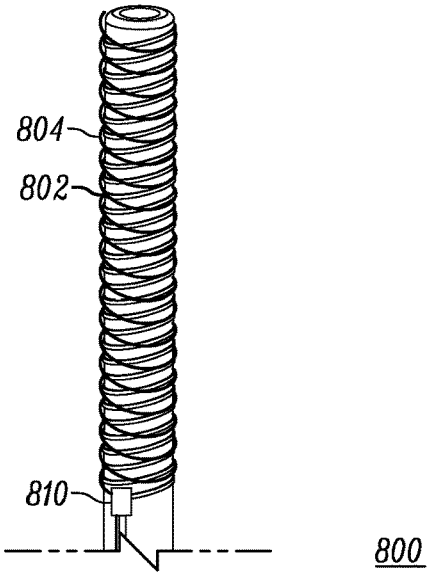
FIG. 8 is an alternative embodiment for a switchably coupled dual contra-wound antenna in accordance with an alternative embodiment.

FIG. 8 is an alternative embodiment for a switchably coupled dual contra-wound antenna 800 in accordance with some of the embodiments. Antenna 800 comprises overlapping coils formed of a primary helical coil 802, a secondary helical coil 804, and a switch 810 coupled therebetween. Suitable non-lossy dielectric material is located between the overlapping coils. Such an antenna 800 can be located external to a portable radio where size constraints are not as limited. In this case the radio mock-up is 105 by 65 mm and the antenna is 105 mm in length. The radio would, as before comprise a transceiver and controller operatively under microprocessor control switchably coupled via a switch 810 to control switching in the secondary helical coil 804 in respond to PTT activation.

During the wideband mode of operation, the switch 810 connects the primary helical coil 802 with the secondary helical coil 804, thereby increasing the antenna electrical length with contra wound coils. during the narrowband mode of operation, the switch disconnects the first helical coil from the second helical coil, and the second helical coil operates as a parasitic element coupled to the first helical coil.

During the narrowband mode of operation, the switch 810 disconnects the primary helical coil 804 from the secondary helical coil 804, and the secondary helical coil operates as a parasitic element coupled to the first helical coil.

With the Switch 810 ON, Wideband passband with two resonant frequencies close by. With switch 810 OFF, a narrowband passband is obtained with additional interference rejection at an out of band frequency. Thus, one independent frequency with both a narrowband and a wideband passband are achieved with the antenna 800. during the narrowband mode of operation, the switch disconnects the first helical coil from the second helical coil, and the second helical coil operates as a parasitic element coupled to the first helical coil.

Figure 9A:
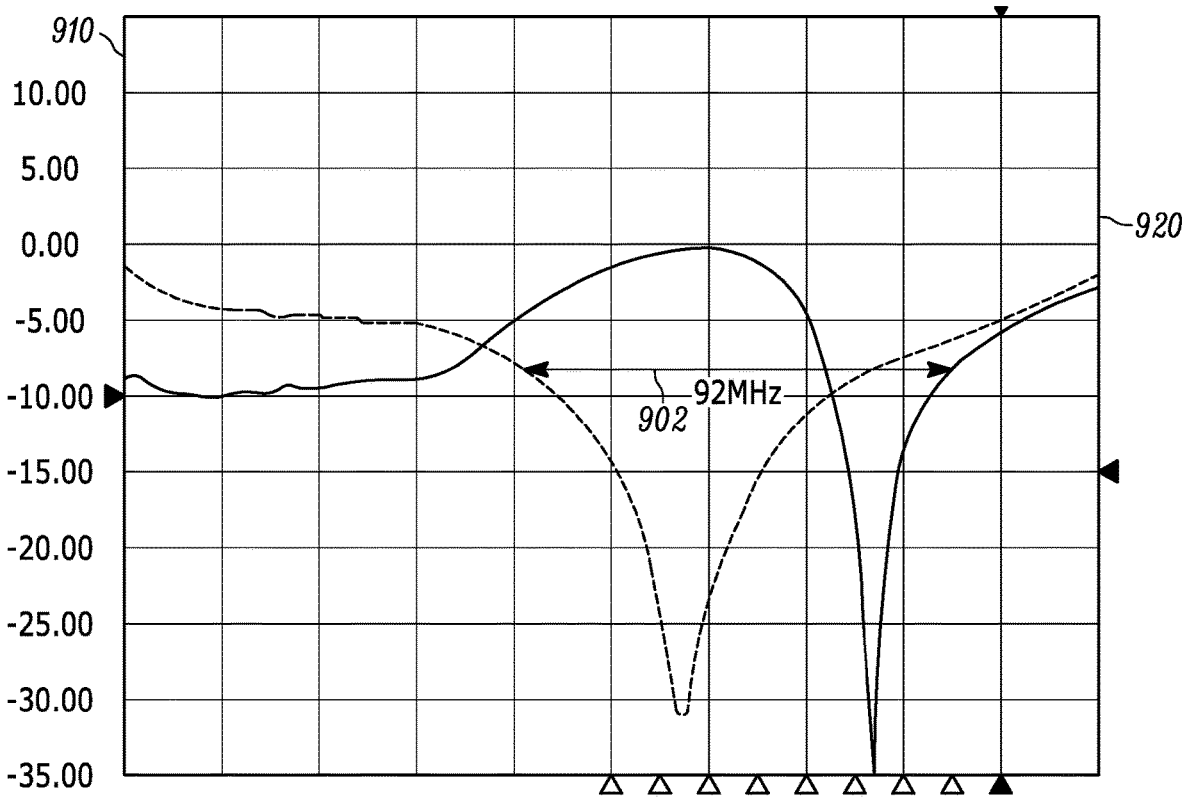
FIG. 9A is a graph of an example of usable bandwidth for an overlapping antenna formed in accordance with the alternative embodiment of FIG. 8.

FIG. 9A shows a graph 900 of an example of usable bandwidth 902 for an overlapping antenna formed in accordance with the alternative embodiment of FIG. 8. Graph 900 shows frequency (MHz) on the vertical axis 910 versus Gain (dB) on the horizontal axis 920. With the switch 810 ON, the two close by resonant frequencies (72 MHz and 20 MHz) provide for a usable bandwidth of 92 MHz.

Figure 9B:
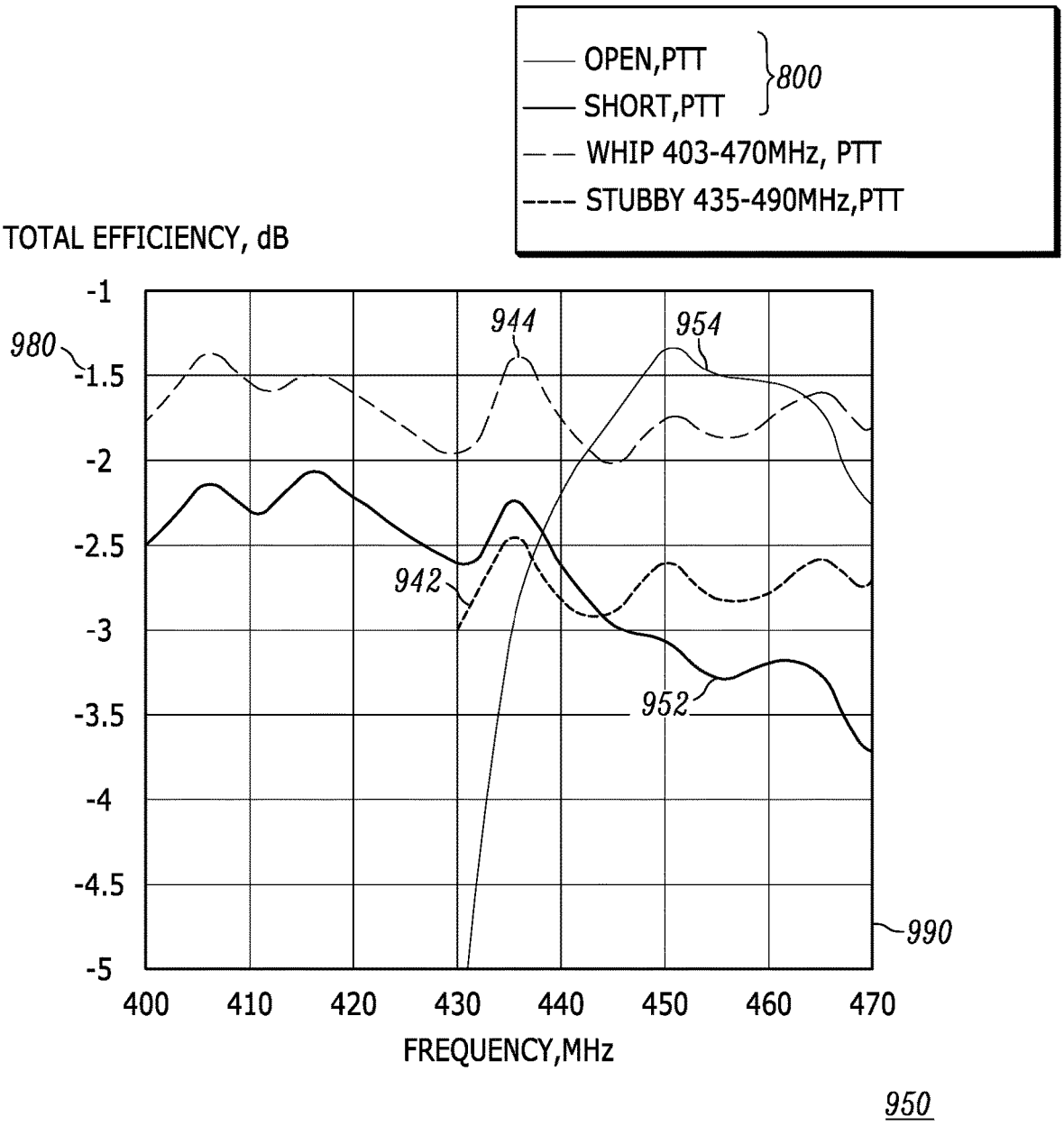
FIG. 9B is a graph of an example of interference rejection for an overlapping antenna formed in accordance with the alternative embodiment of FIG. 8.

FIG. 9B s shows a graph 950 of an example of interference rejection for an overlapping antenna formed in accordance with the alternative embodiment of FIG. 8. Graph 950 shows total efficiency on the vertical axis 930 and frequency (MHz) 940 on the horizontal axis. Two reference antenna responses (regular stubby antenna 942 and whip antenna 944) are shown with wideband responses across the band 400 MHz-470 MHz without rejection. Graph 950 shows the wideband response 952 obtained from antenna 800 while secondary coil 804 is switchably disconnected from the primary helical coil, providing a wideband response without interference rejection. Graph 950 shows the narrowband response 954 obtained while primary coil 802 is switchably connected to secondary coil 804, thereby providing significant rejection.

Table 3 summarizes the properties for antenna 800:

TABLE 3

| | Type of windings | Switch On | Switch Off | Remarks |
|---|---|---|---|---|
| Antenna 800 | Overlap | Wideband Has two resonant frequencies close by | Narrowband with additional interference rejection at out of band frequency | One independent frequency, wideband and narrowband |

The overlapping dual contra-wound switch antenna approach thus advantageously provides advantageously for a wideband antenna with additional interference rejection over standard whip and stubby antennas. Fine tuning of the antenna response and fine tuning of the antenna interference, such as those noted in Table 3, are both more readily tunable via each of the primary and secondary helical coils (as well as other radio components) since the impact of each helical coil is so well defined within the antenna.

Accordingly, antenna 800 provides a switchably coupled dual contra-wound antenna in which first and second contra-wound helical coils are overlapping and provide switchable operation via a switch over a predetermined wideband mode of operation and a narrowband mode of operation. Such an overlapping contra-wound switched structure can now allow for antenna designs to be re-designed into shorter physical lengths by using the overlapping contra-wound switched approach with the added benefit of providing additional interference protection and improved tunability.

Accordingly, in accordance with some embodiments, a switchable, dual contra-wound antenna has been provided. Some embodiments provided for a non-overlapping, switchable dual contra-wound antenna. Other embodiments provided for an overlapping, switchable dual contra-wound antenna.

The non-overlapping, switchable, dual, contra-wound antenna can improve receiver desensitization as well as radiated transmit wideband noise performance. The non-overlapping antenna, switchable, dual, contra-wound antenna can be used to decrease overall internal volume and decrease external length of a portable communication device.

The overlapping, switchable, dual, contra-wound antenna can be used to shorten design lengths for radio antenna and provide the additional benefit of interference rejection of a portable communication device. Such a switchable, dual contra-wound antenna with overlapping coils provided for one independent frequency, a wideband response and a narrowband response.

The antennas provided by the various embodiments are suitable for applications in portable communication devices where shorter, smaller antenna are desired with the ability to selectively provide for passband selectivity and adjustment of interference rejection.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A portable electronic device, comprising:

a controller;

a transceiver;

a push-to-talk (PTT) button operatively coupled to the controller and the transceiver; and a switchably coupled dual contra-wound helical antenna providing radio frequency communication, wherein the switchably coupled dual contra-wound helical antenna comprises:

a first helical coil, a second helical coil, the second helical coil being separate from the first helical coil, the second helical coil having contra-wound coils relative to the first helical coil, and a switch;

the first helical coil operating as an antenna during both a narrowband mode of operation and a wideband mode of operation; and during a wideband mode of operation, the switch connects the first helical coil with the second helical coil, thereby increasing an electrical length of the helical antenna with contra wound coils; and during the narrowband mode of operation, the switch disconnects the first helical coil from the second helical coil, and the second helical coil electromagnetically couples to and operates as a parasitic element to the first helical coil to notch out interference.

2. The portable electronic device of claim 1, wherein the switchably coupled dual contra-wound helical antenna comprises non-overlapping coils or overlapping coils.

3. The portable electronic device of claim 1, wherein:

the first helical coil operates as an antenna for a higher frequency when the switch is open; and when the switch connects the first helical coil with the second helical coil, thereby increasing the antenna electrical length with the contra wound coils, the first helical coil operates as an antenna for a lower frequency.

4. The portable electronic device of claim 1, wherein, when the first helical coil and second helical coil are connected via the switch, each operates at an independent resonant frequency within a predetermined frequency band during the wideband mode of operation.

5. The portable electronic device of claim 1, wherein the portable electronic device operates in a Trans-European Trunked Radio (TETRA) communication band.

6. The portable electronic device of claim 1, wherein the portable electronic device operates in a Global System for Mobile (GSM) band.

7. The portable electronic device of claim 1, wherein said switch includes a pin diode operating as a radio frequency (RF) switch connecting the first helical coil to the second helical coil, upon activation of the PTT.

8. A portable electronic device, comprising:

a controller;

a transceiver;

a push-to-talk (PTT) button operatively coupled to the controller and the transceiver; and a switchably coupled dual contra-wound helical antenna providing radio frequency communication, wherein the switchably coupled dual contra-wound helical antenna comprises:

a primary helical coil;

a secondary helical coil, wherein the secondary helical coil is contra-wound relative to the primary helical coil; and a switch for switchably coupling the secondary helical coil to and from the primary helical coil; and wherein the secondary helical coil couples electromagnetically to the primary helical coil when disconnected via the switch, the second helical coil operating as a parasitic element to notch out interference.

9. The portable electronic device of claim 8, wherein the switch connects the primary helical coil with the secondary helical coil for a wideband mode of operation, and the switch disconnects the primary helical coil from the secondary helical coil for a narrowband mode of operation.

10. The portable electronic device of claim 8, wherein the primary helical coil and secondary helical coil are non-overlapping.

11. The portable electronic device of claim 8, wherein the primary helical coil and secondary helical coil overlap.

* * * * *